US008538284B2

(12) United States Patent
Nakazato

(10) Patent No.: US 8,538,284 B2
(45) Date of Patent: Sep. 17, 2013

(54) IMAGE FORMING APPARATUS CONTROLLING BELT POSITION IN A PERPENDICULAR DIRECTION TO A BELT CONVEYING DIRECTION

(75) Inventor: Jun Nakazato, Kashiwa (JP)

(73) Assignee: Canon Kabushiki Kaisha (JP)

( * ) Notice: Subject to any disclaimer, the term of this patent is extended or adjusted under 35 U.S.C. 154(b) by 337 days.

(21) Appl. No.: 12/568,261

(22) Filed: Sep. 28, 2009

(65) Prior Publication Data

US 2010/0080598 A1 Apr. 1, 2010

(30) Foreign Application Priority Data

Sep. 30, 2008 (JP) ..... 2008-253844

(51) Int. Cl.
*G03G 15/16* (2006.01)
*G03G 15/00* (2006.01)

(52) U.S. Cl.
USPC ..... 399/66; 399/162; 399/302; 399/329

(58) Field of Classification Search
USPC ..... 399/66, 162, 302, 329
See application file for complete search history.

(56) References Cited

U.S. PATENT DOCUMENTS 5,027,160 A * 6/1991 Okada et al. ..... 399/329
5,479,241 A * 12/1995 Hou et al. ..... 399/75
5,518,457 A * 5/1996 Seki et al. ..... 474/102
5,609,428 A * 3/1997 Tanaka et al. ..... 400/579
5,903,805 A 5/1999 Ueda et al.
6,151,048 A * 11/2000 Shiozaki ..... 347/55
7,444,101 B2 10/2008 Calamita
2003/0129000 A1 * 7/2003 Lee et al. ..... 399/165
2003/0219280 A1 * 11/2003 Lee ..... 399/167
2006/0289280 A1 * 12/2006 Furuya et al. ..... 198/806
2007/0144871 A1 * 6/2007 Tao et al. ..... 198/810.03
2008/0089703 A1 4/2008 Calamita
2008/0310891 A1 * 12/2008 Mochizuki ..... 399/302

(Continued)

FOREIGN PATENT DOCUMENTS

JP 09-048533 A 2/1997
JP 2000-016629 A 1/2000

(Continued)

OTHER PUBLICATIONS

Japanese Office Action for corresponding JP 2008-253844, mail date Mar. 5, 2013.

(Continued)

*Primary Examiner* — G. M. Hyder
(74) *Attorney, Agent, or Firm* — Rossi, Kimms & McDowell LLP

(57) ABSTRACT

An image forming apparatus capable of improving the reliability of intermediate transfer belt shift control and attaining a high quality image. The image forming apparatus includes an intermediate transfer belt onto which a toner image is transferred and formed, a shift position detecting sensor that detects a shift position of the belt, a shift control roller that changes the shift position of the belt, and an angle adjustment cam and an angle adjustment arm that correct an inclination angle of the roller. An amount of correction for the inclination angle is calculated by an ASIC based on the belt shift position detected by the sensor. In a Kf multiplier and a Kr multiplier, coefficient values used for the calculation of the amount of correction for the inclination angle can variably be changed independently for respective directions of control for the roller inclination angle.

2 Claims, 10 Drawing Sheets

(56) References Cited

U.S. PATENT DOCUMENTS

| | | | | |
|---|---|---|---|---|
| 2009/0169274 | A1* | 7/2009 | Suzuki et al. | 399/302 |
| 2009/0180805 | A1* | 7/2009 | Nakura et al. | 399/165 |
| 2009/0202275 | A1* | 8/2009 | Nishida et al. | 399/165 |

FOREIGN PATENT DOCUMENTS

| | | | |
|---|---|---|---|
| JP | 2005-326638 | A | 11/2005 |
| JP | 2006-106642 | A | 4/2006 |
| JP | 2008-097008 | A | 4/2008 |

OTHER PUBLICATIONS

Japanese Office Action cited in Japanese counterpart application No. JP2008-253844, dated Jun. 18, 2013.

* cited by examiner

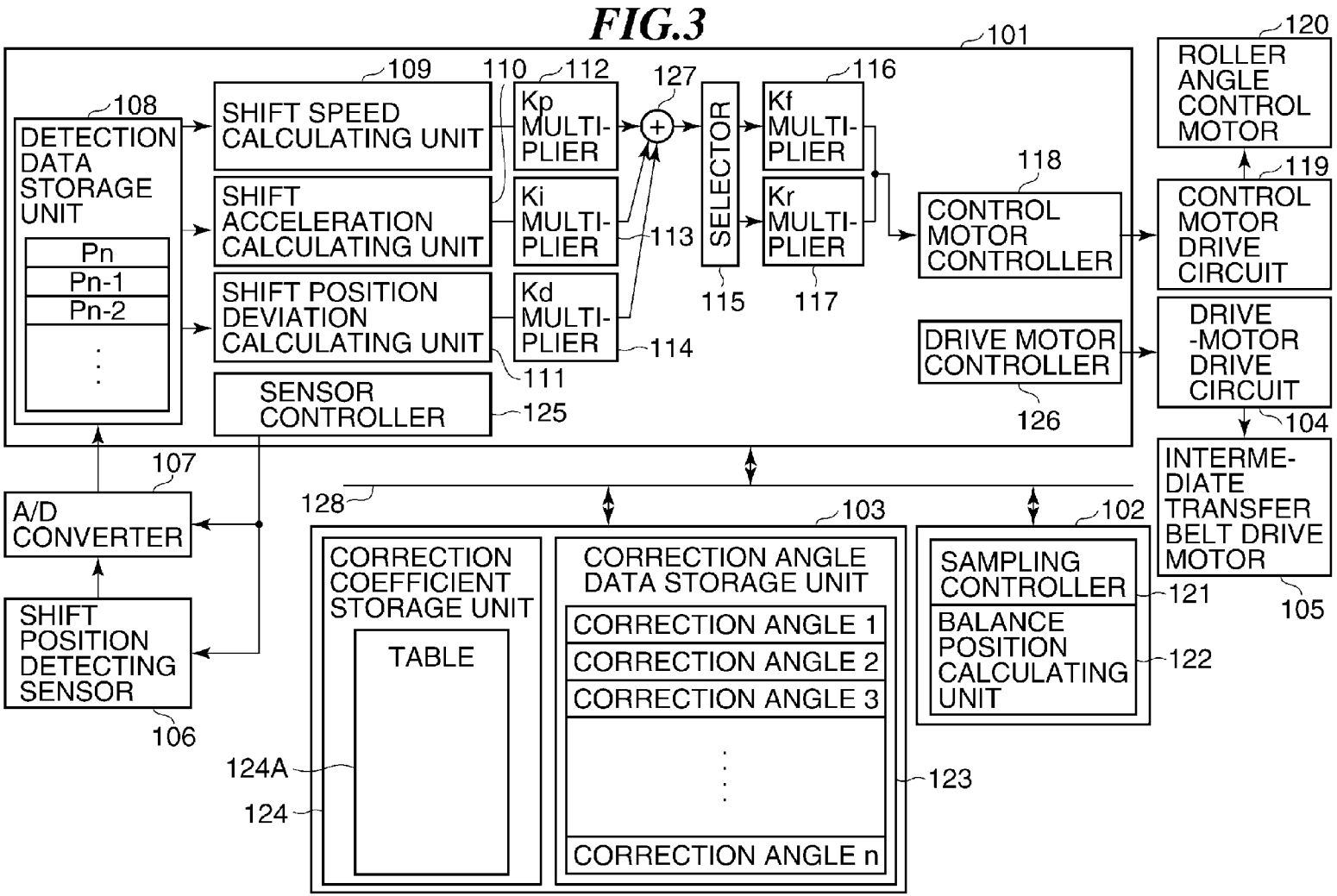
FIG.3
101
ROLLER ANGLE CONTROL MOTOR
120
CONTROL MOTOR DRIVE CIRCUIT
119
DRIVE -MOTOR DRIVE CIRCUIT
104
INTERME-DIATE TRANSFER BELT DRIVE MOTOR
105
CONTROL MOTOR CONTROLLER
118
DRIVE MOTOR CONTROLLER
126
SAMPLING CONTROLLER
121
BALANCE POSITION CALCULATING UNIT
122
102
Kf MULTI-PLIER
116
Kr MULTI-PLIER
117
SELECTOR
115
127
Kp MULTI-PLIER
112
Ki MULTI-PLIER
113
Kd MULTI-PLIER
114
110
111
125
SHIFT SPEED CALCULATING UNIT
109
SHIFT ACCELERATION CALCULATING UNIT
SHIFT POSITION DEVIATION CALCULATING UNIT
SENSOR CONTROLLER
CORRECTION ANGLE DATA STORAGE UNIT
103
CORRECTION ANGLE 1
CORRECTION ANGLE 2
CORRECTION ANGLE 3
CORRECTION ANGLE n
123
CORRECTION COEFFICIENT STORAGE UNIT
TABLE
128
124A
124
DETECTION DATA STORAGE UNIT
108
Pn
Pn-1
Pn-2
A/D CONVERTER
107
SHIFT POSITION DETECTING SENSOR
106

*FIG.4*

| BALANCE POSITION | CORRECTION COEFFICIENT VALUE Kf | CORRECTION COEFFICIENT VALUE Kr |
|---|---|---|
| -10 | 1/3 | 1/10 |
| -8 | 1/3 | 1/9 |
| -6 | 1/4 | 1/8 |
| -4 | 1/4 | 1/7 |
| -2 | 1/5 | 1/6 |
| 0 | 1/5 | 1/5 |
| 2 | 1/6 | 1/5 |
| 4 | 1/7 | 1/4 |
| 6 | 1/8 | 1/4 |
| 8 | 1/9 | 1/3 |
| 10 | 1/10 | 1/3 |

FIG.7A

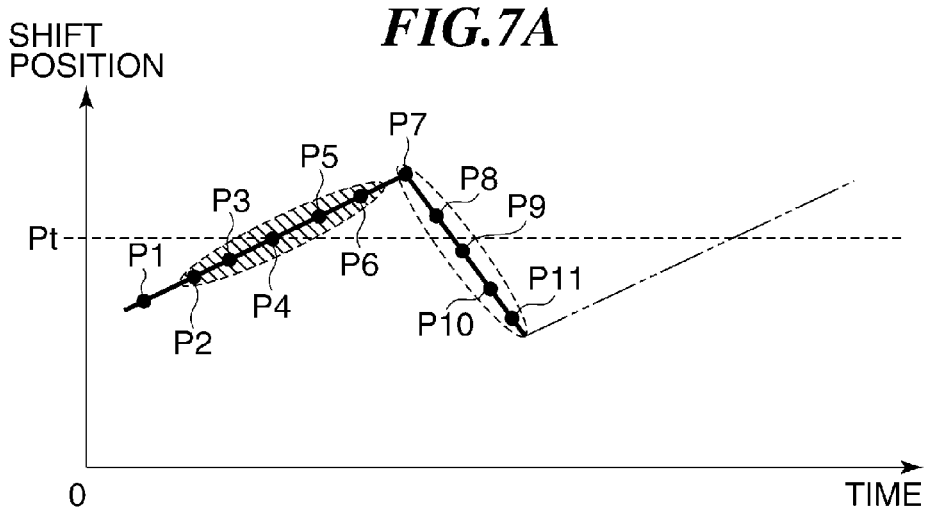

FIG.7B

| | | |
|---|---|---|
| VARIATION 1 | = P1 - Pt | |
| VARIATION 2 | = P2 - Pt | NEGATIVE SIGN |
| VARIATION 3 | = P3 - Pt | |
| VARIATION 4 | = P4 - Pt | |
| VARIATION 5 | = P5 - Pt | |
| VARIATION 6 | = P6 - Pt | POSITIVE SIGN |
| VARIATION 7 | = P7 - Pt | |
| VARIATION 8 | = P8 - Pt | |
| VARIATION 9 | = P9 - Pt | |
| VARIATION 10 | = P10 - Pt | NEGATIVE SIGN |
| VARIATION 11 | = P11 - Pt | |

FIG.7C

| | | |
|---|---|---|
| VARIATION 1 | = P2 - P1 | |
| VARIATION 2 | = P3 - P2 | |
| VARIATION 3 | = P4 - P3 | POSITIVE SIGN |
| VARIATION 4 | = P5 - P4 | |
| VARIATION 5 | = P6 - P5 | |
| VARIATION 6 | = P7 - P6 | |
| VARIATION 7 | = P8 - P7 | |
| VARIATION 8 | = P9 - P8 | NEGATIVE SIGN |
| VARIATION 9 | = P10 - P9 | |
| VARIATION 10 | = P11 - P10 | |

IMAGE FORMING APPARATUS CONTROLLING BELT POSITION IN A PERPENDICULAR DIRECTION TO A BELT CONVEYING DIRECTION

BACKGROUND OF THE INVENTION

1. Field of the Invention

The present invention relates to an image forming apparatus characterized by conveyance control for an endless belt.

2. Description of the Related Art

In endless belt conveying apparatuses, there has been known a technique to enable a belt to travel with stability, while reducing an amount of shift of the traveling belt to a minimum. In the following, a description is given of an example where the belt is an intermediate transfer belt.

With this technique, a side edge position of the intermediate transfer belt is periodically detected by a sensor, and based on detection results, there are calculated an amount of change in intermediate transfer belt shift position, a shift speed, and a deviation of the shift position from a target position. Subsequently, a correction amount is derived and then supplied to a drive source that adjusts an inclination angle of a shift control roller on which the intermediate transfer belt is supported. Then, the roller inclination angle is adjusted by the drive source to realtime control the shift position of the intermediate transfer belt, whereby the side edge position of the intermediate transfer belt is stabilized near the target position (see, Japanese Laid-open Patent Publication No. 2005-326638).

It should be noted that the whole of an image forming apparatus is sometimes distorted due to, e.g., part tolerance, transportation of the apparatus, and/or distortion of an installation place for the apparatus. In that case, a rotating shaft of an intermediate transfer belt support roller is deviated from a desired direction and as a result, a shift speed of the intermediate transfer belt varies depending on directions, thus making it difficult for the above-described prior art to enable the intermediate transfer belt to travel at the target position with stability.

As a result, especially in a case that the intermediate transfer belt conveying apparatus is used in a color image forming apparatus, there is a fear that toner images of respective colors are deviated in their superposed position, resulting in out-of-color registration of a formed image.

SUMMARY OF THE INVENTION

The present invention provides an image forming apparatus capable of improving the reliability of belt shift control and attaining a high quality image.

According to a first aspect of this invention, there is provided an image forming apparatus comprising an endless belt, a control roller around which the belt is wound, a detection device configured to detect detection information each representing a position of the belt in a shift direction, and a control unit configured to control an inclination angle of the control roller based on a result of detection by the detection device, wherein the control unit sets coefficient values which are different depending on directions in which the control roller is inclined, the coefficient values being used for calculation of an amount of correction for the inclination angle of the control roller.

According to a second aspect of this invention, there is provided an image forming apparatus comprising an endless image carrier on which a toner image is transferred and formed, a detection device configured to detect a shift position of the image carrier, a control roller configured to change the shift position of the image carrier, a correction device configured to correct an inclination angle of the control roller, a calculating unit configured to calculate, based on detection information detected by the detection device, an amount of correction for the inclination angle for use by the correction device, a variably changing unit configured to variably change coefficient values independently for respective directions of control for the inclination angle of the control roller, the coefficient values being used by the calculating unit to calculate the amount of correction for the inclination angle, and a decision unit configured to calculate, based on the detection information detected by the detection device, variations in the shift position of the image carrier for the respective directions of control for the inclination angle, and decide the coefficient values based on the calculated variations in the shift position.

Further features of the present invention will become apparent from the following description of exemplary embodiments with reference to the attached drawings.

BRIEF DESCRIPTION OF THE DRAWINGS

FIG. 3 is a block diagram showing an image forming apparatus according to a first embodiment of this invention;

FIG. 4 is a view showing a table for use in intermediate transfer belt shift control;

FIGS. 7A to 7C are views showing how variations in shift position data are calculated, these variations being used for calculation of an intermediate transfer belt shift balance deviation;

DETAILED DESCRIPTION OF THE PREFERRED EMBODIMENTS

The present invention will now be described in detail below with reference to the drawings showing preferred embodiments thereof.

Figure 1:
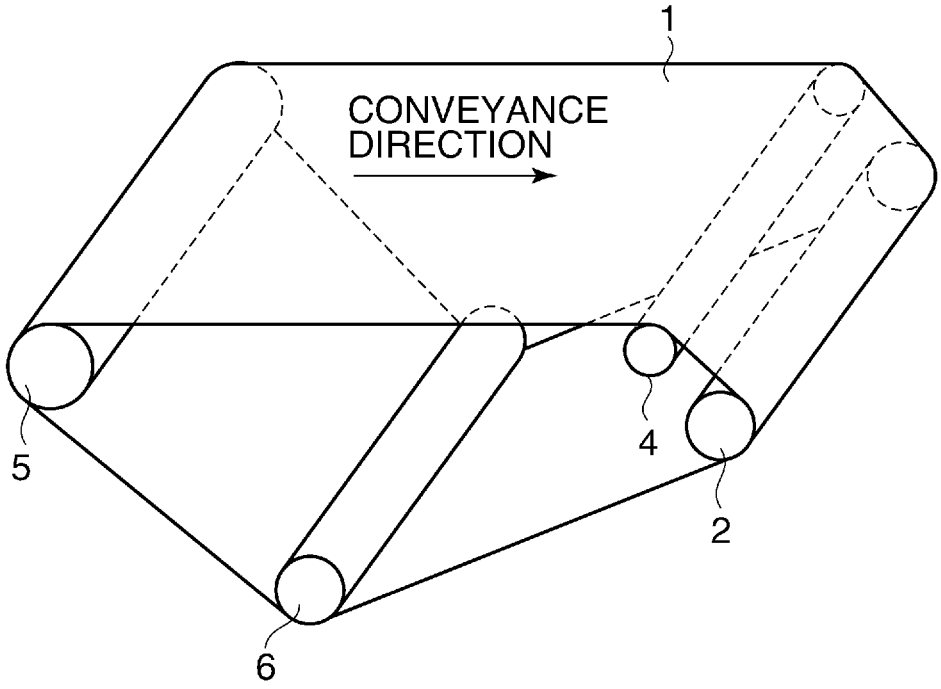
FIG. 1 is a view showing the construction of an intermediate transfer belt conveying apparatus according to one embodiment of this invention.

FIG. 1 shows the construction of an intermediate transfer belt conveying apparatus according to one embodiment of this invention.

As shown in FIG. 1, the intermediate transfer belt conveying apparatus includes a plurality of rollers, around which an endless intermediate transfer belt 1 is mounted, and roller drive motors including an intermediate transfer belt drive motor 105 and a roller angle control motor 120 shown in FIG. 3. The rollers for the intermediate transfer belt 1 include a shift control roller 2, an intermediate transfer belt support roller 4 to maintain the tension of the intermediate transfer belt 1, an intermediate transfer belt drive roller 5 for driving the intermediate transfer belt 1, and a secondary transfer counter roller 6 disposed to face a secondary roller (not shown) for transferring a toner image formed on the intermediate transfer belt 1 onto a transfer material such as a sheet of paper. The intermediate transfer belt 1 is in contact with photosensitive members, e.g., photosensitive drums and configured to be transferred with toner images formed on the photosensitive drums.

In the intermediate transfer belt conveying apparatus, the intermediate transfer belt 1 travels in a conveyance direction indicated by arrow with rotation of the intermediate transfer belt drive roller 5, which is rotatively driven by the intermediate transfer belt drive motor 105 shown in FIG. 3.

Figure 2:
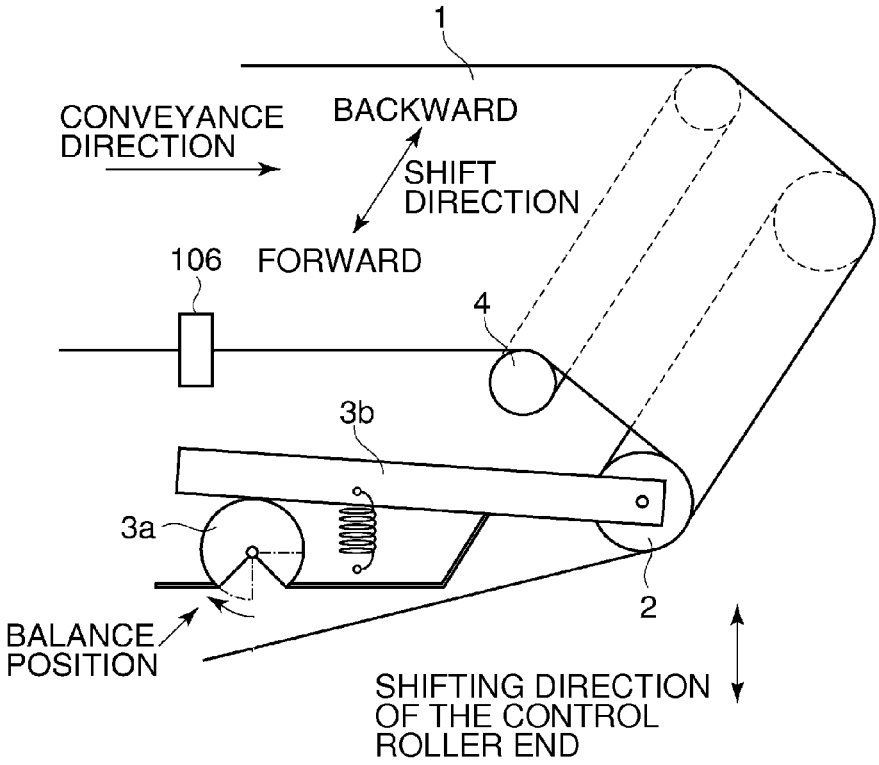
FIG. 2 is a view showing the construction of an essential part of the intermediate transfer belt conveying apparatus shown in FIG. 1.

FIG. 2 shows the construction of an intermediate transfer belt shift control system of the intermediate transfer belt conveying apparatus.

Referring to FIG. 2, the intermediate transfer belt shift control system is configured to vertically move a fore side end of the shift control roller 2 relative to a back side end thereof, thereby controlling an inclination angle of the longitudinal axis of the roller 2 relative to a horizontal plane, to control a shift of the intermediate transfer belt 1 which is traveling.

Specifically, the intermediate transfer belt shift control system is configured to control a rotation angle of an angle adjustment cam 3*a* by the roller angle control motor 120 shown in FIG. 3, which is supplied with an electric current generated by a control motor drive circuit 119 in accordance with a drive pulse signal string supplied from a control motor controller 118, such that one end of an angle adjustment arm 3*b* is vertically moved around a fulcrum. The one end of the arm 3*b* is coupled to a fore side end of a rotary shaft of the control roller 2. With the vertical movement of the one end of the arm 3*b*, the fore side end of the control roller 2 is vertically moved and the inclination angle of the roller 2 is changed. When the fore side end of the control roller 2 is moved upward in unison with the one end of the arm 3*b*, the intermediate transfer belt 1 is moved toward the fore side in a belt shift direction perpendicular to the belt conveyance direction. When the fore side end of the control roller 2 is moved downward in unison with the one end of the arm 3*b*, the intermediate transfer belt 1 is moved toward the back side in the belt shift direction.

A shift position detecting sensor 106 is disposed to face a fore side edge of the intermediate transfer belt 1. The sensor 106 is configured to detect a shift position (i.e., a position of the fore side edge of the intermediate transfer belt 1 in the belt shift direction) and output a detection signal representing the detected shift position. As described later, the detection signal is used as information to control the intermediate transfer belt shift control system.

The intermediate transfer belt 1 functions as an endless image carrier onto which a toner image is transferred and formed. The shift position detecting sensor 106 functions as a detection device for detecting the shift position of the image carrier. The shift control roller 2 functions as a control roller for changing the shift position of the image carrier. The angle adjustment cam 3*a* and the angle adjustment arm 3*b* function as a correction device for correcting the inclination angle of the control roller.

FIG. 3 shows in block diagram an image forming apparatus according to a first embodiment of this invention.

As shown in FIG. 3, the image forming apparatus includes an ASIC (application-specific integrated circuit (highly integrated circuit device)) 101, a CPU 102 (main control processing device), and a RAM (data storage memory) 103.

The ASIC 101, the CPU 102, and the RAM 103 are connected via a data communication line 128 with one another for data reading/writing.

The ASIC 101 controls the intermediate transfer belt drive motor 105 and achieves a primary function of intermediate transfer belt shift control. The CPU 102 controls the entire image forming apparatus and operates according to a program stored in its internal memory. The RAM 103 temporarily stores data at execution of processing by the CPU 102, and is utilized for long-term data storage with a battery (not shown).

The following is a description of an intermediate transfer belt conveying function of the image forming apparatus.

When a drive start command is sent from the CPU 102 to the ASIC 101, a drive motor controller 126 in the ASIC 101 generates a drive pulse signal string for driving the intermediate transfer belt drive motor 105 at a rotational speed corresponding to an intermediate transfer belt traveling speed.

The drive pulse signal string is sent to a drive-motor drive circuit 104 that controls electric current to be supplied to the intermediate transfer belt drive motor 105. A driving force generated by the intermediate transfer belt drive motor 105 is conveyed via gears (not shown) to the intermediate transfer belt drive roller 5, whereby the intermediate transfer belt 1 travels in the conveyance direction.

Next, an intermediate transfer belt shift control function of the image forming apparatus is described.

The shift position detecting sensor 106 disposed near the side edge of the intermediate transfer belt 1 is driven at intervals of a predetermined period according to a sensor drive command from a sensor controller 125 of the ASIC 101. Analog signal data detected by the shift position detecting sensor 106 and representing a shift position of the intermediate transfer belt 1 is converted into digital signal data by an A/D converter 107.

The digitized signal data are read into the ASIC 101 and stored in sequence into a detection data storage unit 108 for temporary data storage. The latest shift position data in the storage unit 108 is represented by $P_n$, and immediately preceding sampled shift position data and further preceding shift position data therein are represented by $P_{n-1}$ and $P_{n-2}$, respectively.

A shift speed, a shift acceleration, and a shift position deviation are calculated on the basis of the shift position data $P_n$, $P_{n-1}$, and $P_{n-2}$ stored in the detection data storage unit 108 by a shift speed calculating unit 109, a shift acceleration calculating unit 110, and a shift position deviation calculating unit 111, respectively, in accordance with the following formulae (a), (b) and (c).

$$\text{Shift speed}=P_{n-1}-P_n \quad \text{(a)}$$

$$\text{Shift acceleration}=2\times P_{n-1}P_{n-2}-P_n \quad \text{(b)}$$

$$\text{Shift position deviation}=\text{Target position}-P_n \quad \text{(c)}$$

Next, the calculated shift speed, shift acceleration, and shift position deviation are multiplied by coefficient values Kp, Kd and Ki, respectively, by a Kp multiplier 112, Kd multiplier 113, and Ki multiplier 114, whereby a shift speed, shift acceleration, and shift position deviation after coeffi cient multiplication are determined, as shown by the following formulae (d), (e) and (f).

$$\text{Shift speed after coefficient multiplication} = \text{Shift speed} \times Kp \quad (d)$$

$$\text{Shift acceleration after coefficient multiplication} = \text{Shift acceleration} \times Kd \quad (e)$$

$$\text{Shift position deviation after coefficient multiplication} = \text{Shift position deviation} \times Ki \quad (f)$$

Next, the shift speed, shift acceleration, and shift position deviation after coefficient multiplication are added together by an adder 127, thereby determining a shift PID (Proportional Integral Differential) sum as shown in the following formula (g).

$$\text{Shift PID sum} = \text{Shift speed} \times \text{Kp Shift acceleration} \times Kd + \text{Shift position deviation} \times Ki \quad (g)$$

The following is a description of characterizing parts of the image forming apparatus.

Based on the sign of the shift PID sum, a selector 115 determines a direction in which the shift control roller angle control motor 120 is to be rotated. If the shift PID sum has, e.g., a negative sign and the control motor 120 is to be rotated in a direction to move the intermediate transfer belt 1 toward the fore side, the selector 115 connects the adder 127 with a Kf multiplier 116. On the other hand, if the shift PID sum has, e.g., a positive sign and the control motor 120 is to be rotated in a direction to move the intermediate transfer belt 1 toward the back side, the selector 115 connects the adder 127 with a Kr multiplier 117.

In the Kf multiplier 116 and the Kr multiplier 117, the shift PID sum is multiplied by respective ones of forward and backward correction coefficient values Kf and Kr, which are set independently of each other, thereby calculating forward and backward shift correction amounts F and R, as shown in the following formulae (h1) and (h2).

$$\text{Forward shift correction amount } F = \text{Shift PID sum} \times Kf \quad (h1)$$

$$\text{Backward shift correction amount } R = \text{Shift PID sum} \times Kr \quad (h2)$$

Next, internal functions of the CPU 102 and the RAM 103 for deciding the forward and backward correction coefficient values Kf, Kr are described.

The CPU 102 includes a sampling controller 121 that has a control function of reading, at intervals of a predetermined period, the shift correction amounts F, R calculated by the Kf and Kr multipliers 116, 117.

In this regard, the sampling controller 121 has a function of determining whether the shift position of the intermediate transfer belt 1 is within a predetermined range, and starting the reading of the shift correction amounts F, R when determining that the shift position is within the predetermined range.

With that function of the sampling controller 121, it is possible to read the shift correction amounts F, R in a state that the shift control roller 2 is substantially balanced in alignment (inclination angle) and the rotational angular position of the output shaft of the roller angle control motor 120 for the control roller 2 is stabilized. Integration values of the thus read shift correction amounts, which represent rotational angular positions after correction of the roller angle control motor 120, are sequentially stored as correction angle data (correction angles 1 to n) into the correction angle data storage unit 123 of the RAM 103.

A balance position calculating unit 122 of the CPU 102 has a function of calculating an average value of plural pieces of correction angle data stored in the storage unit 123. The average value represents a balance position where the inclination angle of the shift control roller 2 (the rotational angular position of the output shaft of the roller angle control motor 120) is balanced.

A correspondence table 124A shown in FIG. 4 and representing a relation between balance position and correction coefficient values Kf, Kr is stored in advance in a correction coefficient storage unit 124 of the RAM 103. By referring to the table 124A, the balance position calculating unit 122 decides the forward and backward correction coefficient values Kf, Kr according to the balance position. It should be noted that the balance position has its initial value of zero. Backward shift speed increases with the increase in balance position in negative direction, whereas forward shift speed increases with the increase in balance position in positive direction. The correspondence table 124A shown in FIG. 4 is derived beforehand according to the construction of the image forming apparatus.

At the time of deciding the coefficient values Kf and Kr, the ASIC 101 functions as a calculating unit that calculates, based on detection information detected by the detection device, an amount of correction for the inclination angle for use by the correction device.

The Kf multiplier 116 and the Kr multiplier 117 function as a variably changing unit that variably changes coefficient values independently for respective directions of control for the inclination angle of the control roller, the coefficient values being used by the calculating unit to calculate the amount of correction for the inclination angle.

The CPU 102 and the RAM 103 function as a decision unit that calculates, based on the detection information detected by the detection device, variations in the shift position of the image carrier for respective directions of control for the inclination angle, and decides the coefficient values for use by the variably changing unit based on the calculated variations in the shift position.

The CPU 102 and the RAM 103 also function as a second decision unit that derives, based on the amount of correction for the inclination angle for use by the correction device, a balance position where the inclination angle of the control roller is balanced, and decides the coefficient values for use by the variably changing unit based on the derived balance position.

Figure 5:
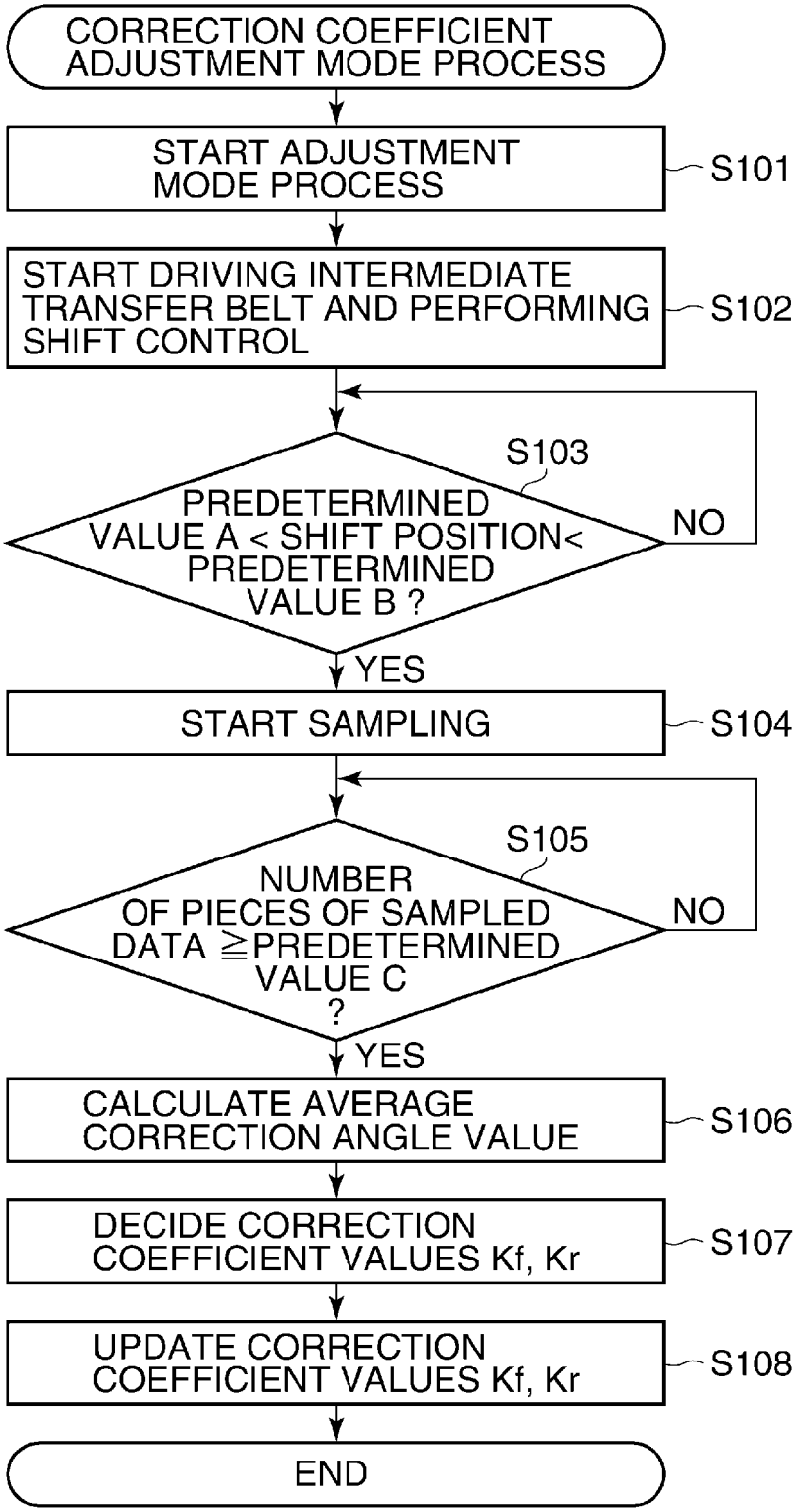
FIG. 5 is a flowchart showing the procedures of a correction coefficient adjustment mode process executed by the image forming apparatus in FIG. 3.

FIG. 5 shows in flowchart the procedures of a correction coefficient adjustment mode process executed by the image forming apparatus in FIG. 3.

In step S101 in FIG. 5, the CPU 102 starts the correction coefficient adjustment mode process. This process is executed when the intermediate transfer belt 1 is newly mounted or replaced or when rollers of the intermediate transfer belt conveying apparatus are replaced at factory shipment or service maintenance in the market.

At the start of the correction coefficient adjustment mode process, the CPU 102 starts driving the intermediate transfer belt 1 and performing shift control (step S102).

The CPU 102 then determines whether a shift position of the intermediate transfer belt 1 detected by the shift position detecting sensor 106 is within a range between predetermined values A and B (step S103). When it is determined that the detected shift position is within the range, the process proceeds to step S104.

In step S104, the CPU 102 starts reading a shift correction amount in accordance with an instruction from the sampling controller 121.

Until the number of pieces of read data of shift correction amount reaches a predetermined value C, the CPU 102 repeats control to sequentially store correction angle data into the correction angle data storage unit 123 of the RAM 103 (step S105).

Next, the CPU 102 calculates an average correction angle value (balance position) based on the pieces of correction angle data stored in the storage unit 123 and corresponding in number of pieces to the predetermined value C (step S106).

In step S107, referring to the table 124A stored in the correction coefficient storage unit 124 of the RAM 103, the CPU 102 finds correction coefficient values Kf and Kr corresponding to the balance position calculated in step S106. Then, the CPU 102 updates the correction coefficient values Kf, Kr in the Kf and Kr multipliers 116, 117, so that the correction coefficient values Kf, Kr found in step S107 will be used for the next and subsequent calculations of the shift correction amounts F, R (step S108).

According to the first embodiment, it is possible to reduce a deviation between forward and backward shift speeds of the intermediate transfer belt 1, which is caused by, e.g., a distortion of the image forming apparatus, whereby the stability of the intermediate transfer belt shift control can be enhanced.

Figure 6:
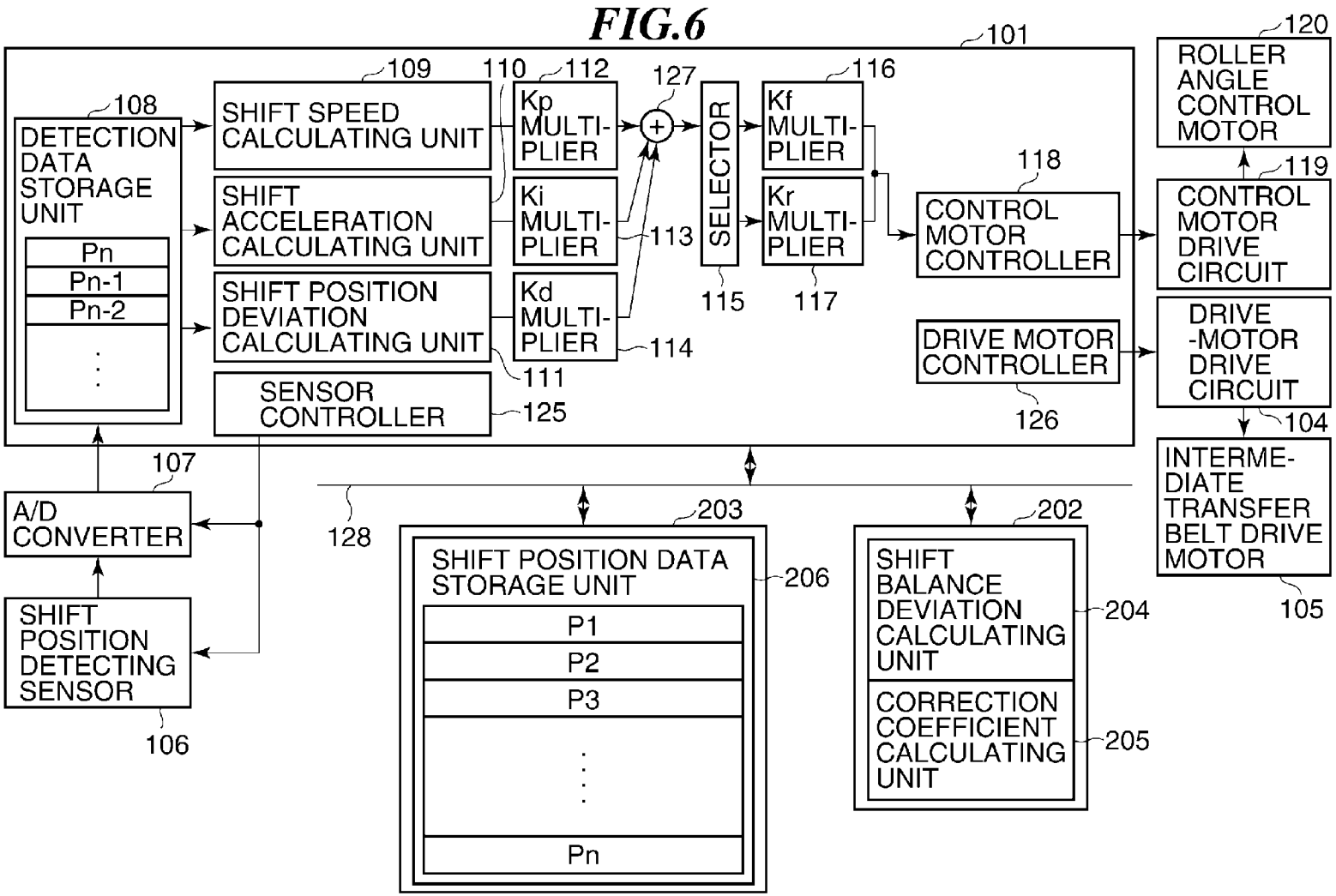
FIG. 6 is a block diagram showing an image forming apparatus according to a second embodiment of this invention.

FIG. 6 shows in block diagram an image forming apparatus according to a second embodiment of this invention.

Like parts common to those of the first embodiment in FIG. 3 are denoted by like numerals, and a duplicated description thereof will be omitted.

Functions that characterize the second embodiment are achieved by a shift balance deviation calculating unit 204 and a correction coefficient calculating unit 205 of the CPU 202 and a shift position data storage unit 206 of the RAM 203 in which data for shift balance calculation are stored.

The following is a description of their functions.

The shift balance deviation calculating unit 204 of the CPU 202 sequentially reads shift position data $P_n$, $P_{n-1}$, $P_{n-2}$, . . . temporarily stored in the detection data storage unit 108 of the ASIC 101, and stores these data into the shift data storage unit 206 of the RAM 203. Thus, a much larger quantity of shift position data $P_i$ (i=1, 2, . . . , m (m>n)) can be held in the shift data storage unit 206 than in the detection data storage unit 108.

The shift balance deviation calculating unit 204 has a function of using the shift position data $P_i$ stored in the shift data storage unit 206 to calculate a shift balance deviation by a calculation method described below with reference to FIGS. 7A to 7C.

The shift balance deviation calculating unit 204 acquires plural pieces of latest shift position data $P_i$ (i=1, 2, . . . ) from the shift position data storage unit 206, and subtracts a target position data $P_t$ from each shift position data $P_i$ to sequentially calculate variations i (i=1, 2, . . . ), as shown in the following formula (i).

$$\text{Variation } i = P_i - P_t \quad \text{(i)}$$

Next, the shift balance deviation calculating unit 204 extracts, from shift position data around local maximum or local minimum shift position data, predetermined pieces of shift position data each equal to or larger than the target position data $P_t$ and providing a zero or positive variation and predetermined pieces of shift position data each smaller than the target position data $P_t$ and providing a negative variation. In an example shown in FIGS. 7A and 7B, five pieces of shift position data $P_2$, $P_3$ and $P_9$ to $P_{11}$ each smaller than the target position data $P_t$ and five pieces of shift position data $P_4$ to $P_8$ each equal to or larger than the target position data $P_t$ are extracted.

Next, the shift balance deviation calculating unit 204 averages the positive variations to determine a positive-side average variation and averages the negative variations to determine a negative-side average variation, as shown in the following formulae (j) and (k).

$$\text{Positive-side average variation} = \{(P_4-P_t)+(P_5-P_t)+(P_6-P_t)+(P_7-P_t)+(P_8-P_t)\}/5 \quad \text{(j)}$$

$$\text{Negative-side average variation} = \{(P_2-P_t)+(P_3-P_t)+(P_9-P_t)+(P_{10}-P_t)+(P_{11}-P_t)\}/5 \quad \text{(k)}$$

Next, as shown by the following equation (l), the shift balance deviation calculating unit 204 subtracts the negative-side average variation calculated according to formula (k) from the positive-side average variation calculated according to formula (j), thereby determining a shift balance deviation.

$$\text{Shift balance deviation} = \text{Positive-side average variation} - \text{Negative-side average variation} \quad \text{(l)}$$

Instead of according to formulae (i) to (l), the shift balance deviation can be determined according to the following formulae (i') to (l').

In that case, the shift balance deviation calculating unit 204 acquires from the shift position data storage unit 206 predetermined pieces of latest shift position data $P_i$ (i=1, 2, . . . ), and sequentially calculates differences between adjacent position data as variations i, as shown by the following formula (i').

$$\text{Variation } i = P_{i+1} - P_i \quad \text{(i')}$$

Next, the shift balance deviation calculating unit 204 determines the sign of each variation (changing direction of shift position data), and extracts, from shift position data around local maximum or local minimum shift position data, predetermined pieces of shift position data in a shift-position increase zone and predetermined pieces of shift position data in a shift-position decrease zone. In the example shown in FIGS. 7A and 7C, five pieces of shift position data $P_2$ to $P_6$ in a shift-position increase zone (a hatched zone in FIG. 7A) and five pieces of shift position data $P_7$ to $P_{11}$ in a shift-position decrease zone (a zone surrounded by dotted line in FIG. 7A) are extracted. Next, as shown by the following formulae (j'), (k'), the calculating unit 204 averages the shift position data in the shift-position increase zone to determine an average variation in shift-position increase direction, and averages the shift position data in the shift-position decrease zone to determine an average variation in shift-position decrease direction.

$$\text{Average variation in shift-position increase direction} = \{(P_3-P_2)+(P_4-P_3)+(P_5-P_4)+(P_6-P_5)\}/4 \quad \text{(j')}$$

$$\text{Average variation in shift-position decrease direction} = \{(P_8-P_7)+(P_9-P_a)+(P_{10}-P_9)+(P_{11}-P_{10})\}/4 \quad \text{(k')}$$

Next, as shown in the following formula (l'), a shift balance deviation is determined by subtracting the average variation in shift-position decrease direction determined according to formula (k') from the average variation in shift-position increase direction determined according to formula (j').

$$\text{Shift balance deviation} = \text{Average variation in shift-position increase direction} - \text{Average variation in shift-position decrease direction} \quad \text{(l')}$$

Next, the correction coefficient calculating unit 205 calculates correction coefficient values Kf, Kr by multiplying the shift balance deviation determined according to formula (l) or (l') by a predetermined value (e.g., 0.1) as shown in the following formula (m), and updates the correction coefficient values Kf, Kr in the Kf and Kr multipliers 116, 117 to the calculated values.

$$\text{Correction coefficient values } Kf, Kr = \text{Shift balance deviation} \times \text{Predetermined value} \quad \text{(m)}$$

It should be noted that the method for calculating the correction coefficient values is not limited to the above example where the shift balance deviation is multiplied by the predetermined value. For example, correction coefficient values Kf, Kr corresponding to a shift balance deviation can be determined by using a table in which correction coefficient values Kf, Kr are made corresponding to shift balance deviations. Furthermore, the predetermined value is not limited to 0.1.

Figure 8:
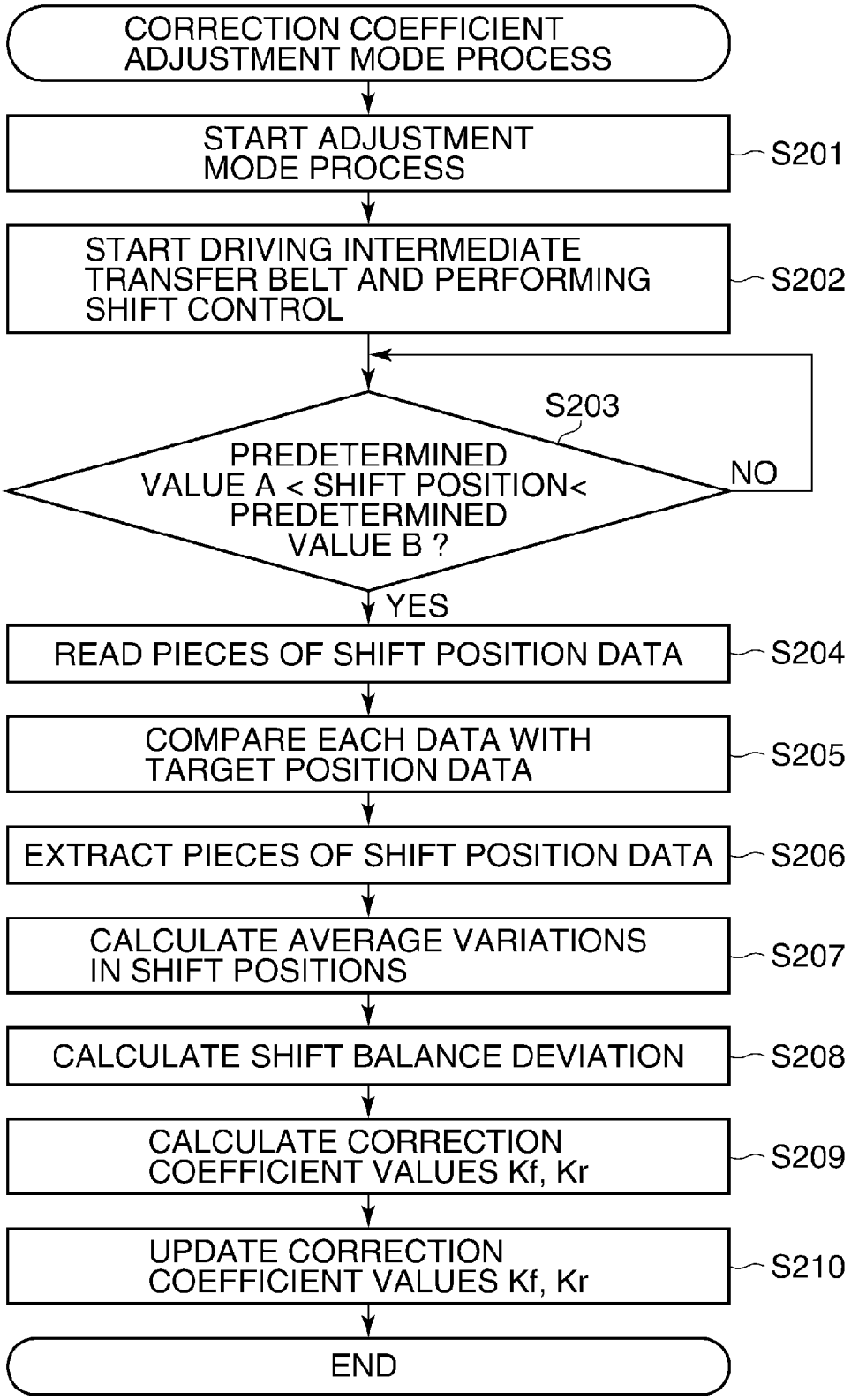
FIG. 8 is a flowchart showing the procedures of a correction coefficient adjustment mode process executed by the image forming apparatus in FIG. 6.

FIG. 8 shows in flowchart the procedures of a correction coefficient adjustment mode process executed by the image forming apparatus in FIG. 6.

In step S201 in FIG. 8, the CPU 202 starts the correction coefficient adjustment mode process. As with the first embodiment, this process is executed, e.g., at factory shipment.

Next, the CPU 202 starts driving the intermediate transfer belt and performing shift control (step S202). Then, the CPU 202 determines whether a shift position of the intermediate transfer belt 1 detected by the shift position detecting sensor 106 is within a range between predetermined values A and B (step S203). When it is determined that the detected shift position is within the range, the process proceeds to step S204.

In step S204, the CPU 202 reads pieces of shift position data and sequentially stores the data for shift balance calculation into the shift position data storage unit 206 of the RAM 203 while the intermediate transfer belt 1 rotates nearly three times.

Next, the CPU 202 compares each of the read shift position data with target shift position data (step S205), and based on results of comparison, extracts pieces of shift position data from the read shift position data (step S206).

Using the shift position data extracted in step S206, the CPU 202 calculates average variations in shift positions in accordance with formulae (j), (k) or (j') (k') (step S207).

In step S208, in accordance with formula (l) or (l'), the CPU 202 calculates a shift balance deviation based on the average variations calculated in step S207.

In accordance with formula (m), the CPU 202 multiplies the shift balance deviation by a predetermined value, thereby calculating correction coefficient values Kf, Kr (step S209).

Then, the CPU 202 updates the correction coefficient values Kf, Kr in the Kr and Kf multipliers 116, 117 to the values calculated in step S209 (step S210).

According to the second embodiment, as with the first embodiment, it is possible to reduce a deviation between forward and backward shift speeds of the intermediate transfer belt 1 which is caused by, e.g., a distortion of the image forming apparatus, whereby the stability of the intermediate transfer belt shift control can be enhanced. With the second embodiment, since an unstable shift operation state can be measured by detecting actual shift position data during conveyance of the intermediate transfer belt, effects greater than those attained by the first embodiment can be achieved.

Figure 9:
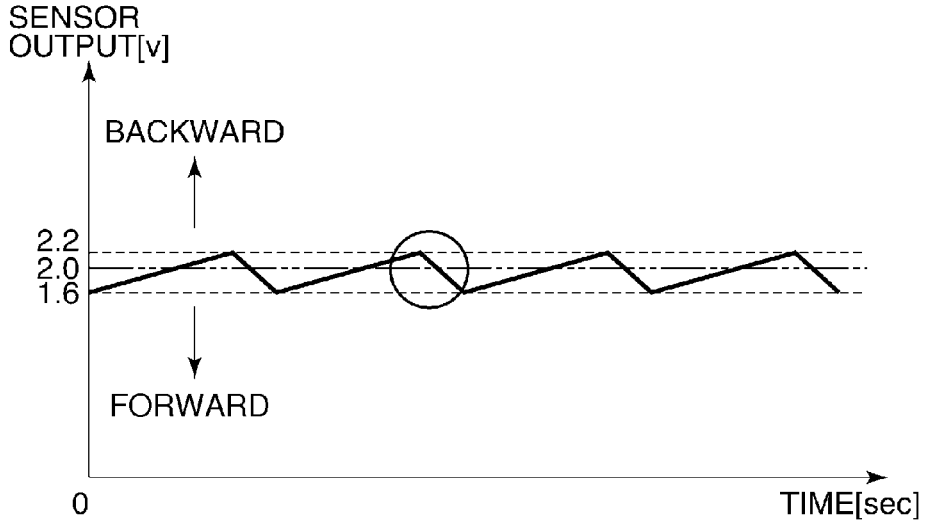
FIG. 9 is a view showing a sensor output waveform (intermediate transfer belt meandering waveform) observed when a shift operation becomes unstable during execution of prior art shift control.

FIG. 9 shows a sensor output waveform (intermediate transfer belt meandering waveform) observed when a shift operation becomes unstable during execution of prior art shift control.

In an example shown in FIG. 9, shift control of the intermediate transfer belt 1 is performed with a target sensor output of 2.0 volts, and there is a difference between forward and backward shift speeds. Specifically, as shown by a region surrounded by a circle in FIG. 9, the forward shift speed is higher than the backward shift speed in this example. This is because, due to, e.g., a distortion of the image forming apparatus, the moving speed of the intermediate transfer belt 1 differs depending on rotation directions of the output shaft of the roller angle control motor 120, even if the rotation speed thereof is kept the same.

In addition, there is a delay time from when the roller angle control motor 120 is driven to when the shift operation of the intermediate transfer belt 1 actually starts. Thus, convergence to a target rotational angle becomes worse and an amount of variation becomes large. As a result, especially in the case of a color image forming apparatus, there is a fear that toner images of respective colors are deviated in their superposed position, resulting in unacceptable out-of-color registration of a formed image.

Figure 10:
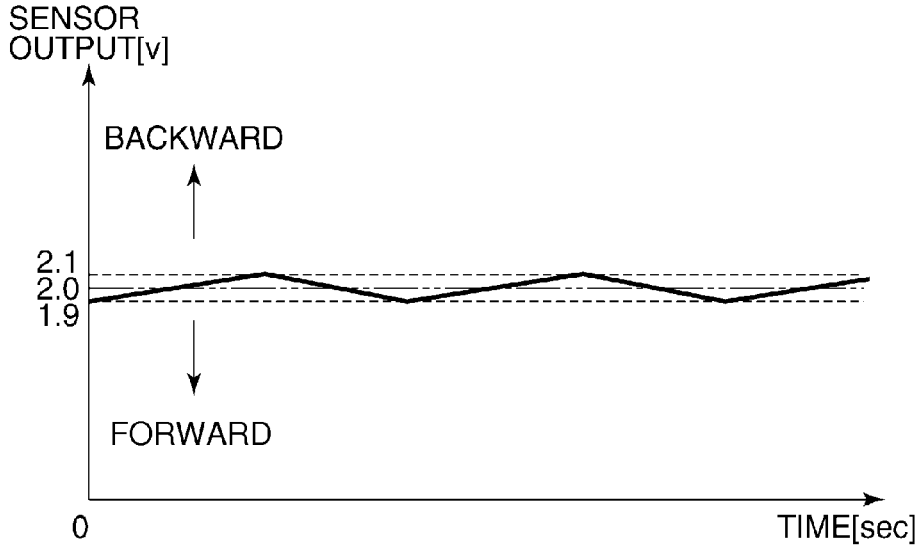
FIG. 10 is a view showing a sensor output waveform (intermediate transfer belt meandering waveform) observed when an imbalance between forward and backward shift operations in intermediate transfer belt shift control is reduced by executing a correction coefficient adjustment mode process in the image forming apparatus of this invention.

FIG. 10 shows a sensor output waveform (intermediate transfer belt meandering waveform) observed when an imbalance between forward and backward shift operations in intermediate transfer belt shift control is reduced by executing a correction coefficient adjustment mode process in the image forming apparatus of this invention.

As shown in FIG. 10, the forward and backward shift speeds are made substantially the same as each other, whereby an amount of meandering of the intermediate transfer belt 1 becomes small, thus making it possible to perform belt position control with satisfactory convergence to a target position.

In the above, the image forming apparatus having the intermediate transfer belt has been described as an example, however, this invention is also applicable to an image forming apparatus having a fixing belt for transferring and fixing a toner image onto a transfer material and/or a conveyance belt for conveying a transfer material.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-253844, filed Sep. 30, 2008, which is hereby incorporated by reference herein in its entirety.

What is claimed is:

1. An image forming apparatus comprising:

an endless belt;

a control roller around which the endless belt is wound;

a detection device configured to detect a position of the endless belt in a direction orthogonal to a conveyance direction to which the endless belt is conveyed;

a storage unit configured to store positions of the endless belt repeatedly-detected by the detection device;

a determination unit configured to determine whether the endless belt should shift toward a first direction, which is a direction orthogonal to the conveyance direction, or toward a second direction, which is a direction opposite to the first direction, based on the positions of the endless belt stored in the storage unit;

a setting unit configured to set a shift amount by which the endless belt should shift toward the first or second direction as a first or second shift amount based on the positions of the endless belt stored in the storage unit, wherein the setting unit:

(i) sets, if the determination unit determines that the endless belt should shift toward the first direction, the shift amount as the first shift amount based on a first predetermined data and the positions of the endless belt stored in the storage unit, and (ii) sets, if the determination unit determines that the endless belt should shift toward the second direction, the shift amount as the second shift amount based on a second predetermined data, which is different from the first predetermined data, and the positions of the endless belt stored by the storage unit;

a control unit configured to control an angle of a rotating shaft of the control roller based on the shift amount set by the setting unit; and an updating unit configured to update, if an updating mode for updating the first predetermined data and the second predetermined data is performed, the first predetermined data and the second predetermined data based on a plurality of shift amount newly set, during the time when the control unit controls the angle of the rotating shaft of the control roller, by the setting unit.

2. The image forming apparatus according to claim 1, further comprising:

a data storage unit configured to store a plurality of combinations of the first predetermined data and the second predetermined data, wherein the updating unit decides, if the updating mode is performed, one combination of the first predetermined data and the second predetermined data from among the plurality of combinations of the first predetermined data and the second predetermined data stored in the data storage unit based on the plurality of shift amount newly set, during the time when the control unit controls the angle of the rotating shaft of the control roller, by the setting unit.

* * * * *